US006297790B1

(12) United States Patent
Goode, III et al.

(10) Patent No.: US 6,297,790 B1
(45) Date of Patent: Oct. 2, 2001

(54) GAMMA CORRECTION OF THE VIEWING ANGLE OF LIQUID CRYSTAL DISPLAY

(75) Inventors: Joseph W. Goode, III, Alpharetta; James D. Cleland, Jonesboro; James M. Brannen, Atlanta, all of GA (US)

(73) Assignees: Universal Avionics Systems Corporation, Norcross, GA (US); Instrument Division and L-3 Communications Corporation, New York, NY (US)

( * ) Notice: Subject to any disclaimer, the term of this patent is extended or adjusted under 35 U.S.C. 154(b) by 0 days.

(21) Appl. No.: 09/227,904

(22) Filed: Jan. 8, 1999

Related U.S. Application Data

(60) Provisional application No. 60/070,950, filed on Jan. 9, 1998.

(51) Int. Cl.[7] ..... G09G 3/36

(52) U.S. Cl. ..... 345/87; 345/94; 345/95; 345/98; 348/254; 349/119

(58) Field of Search ..... 345/87, 94, 95, 345/98; 348/254; 349/119

(56) References Cited

U.S. PATENT DOCUMENTS

| | | | | |
|---|---|---|---|---|
| Re. 33,882 | | 4/1992 | Morozumi | 345/88 |
| 4,319,237 | | 3/1982 | Matsuo et al. | 340/713 |
| 4,984,872 | | 1/1991 | Vick | 350/321 |
| 5,109,219 | | 4/1992 | Kastan et al. | 345/94 |
| 5,150,235 | | 9/1992 | Haim et al. | 359/68 |
| 5,456,867 | | 10/1995 | Mazaki et al. | 264/2.6 |
| 5,489,917 | | 2/1996 | Ikezaki et al. | 345/89 |
| 5,526,150 | | 6/1996 | Mazaki et al. | 359/73 |
| 5,528,257 | | 6/1996 | Okumura | 345/99 |
| 5,589,954 | | 12/1996 | Watanabe | 358/518 |
| 5,612,801 | * | 3/1997 | Winker | 349/119 |
| 5,625,387 | * | 4/1997 | Moon | 345/147 |
| 5,650,796 | * | 7/1997 | Owaki et al. | 345/94 |

* cited by examiner

*Primary Examiner*—Bipin Shalwala
*Assistant Examiner*—Vincent E. Kovalick
(74) *Attorney, Agent, or Firm*—Standley & Gilcrest LLP

(57) ABSTRACT

The present invention is directed to a method and apparatus for adjusting the viewing angle of a liquid crystal display. In a preferred embodiment of the present invention, a plurality of digital-to-analog converters are arranged in pairs which have a fixed relationship. By determining appropriate values for the digital-to-analog converters, a desired viewing angle may be obtained for a liquid crystal display.

1 Claim, 8 Drawing Sheets

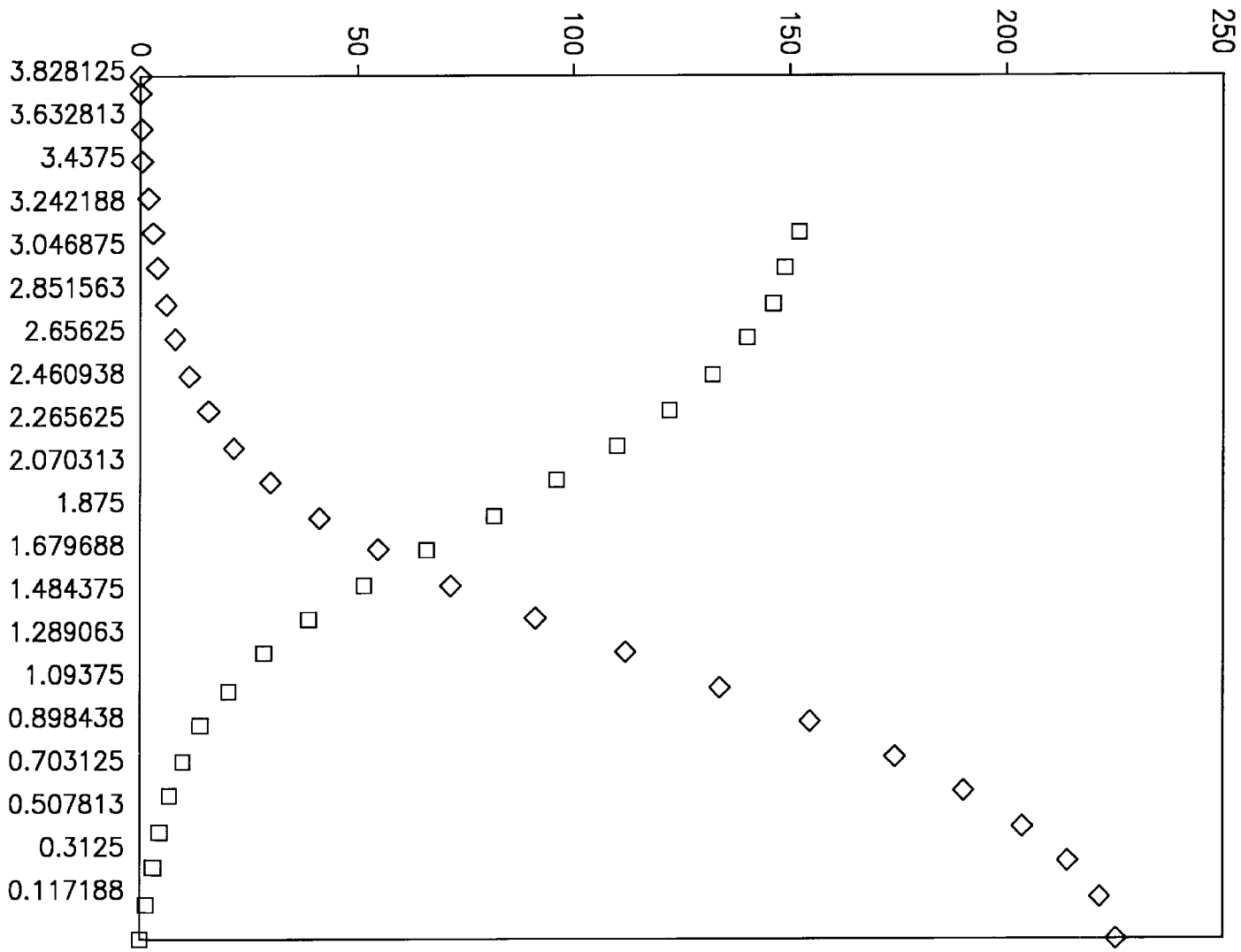
FIG−2

GAMMA CORRECTION OF THE VIEWING ANGLE OF LIQUID CRYSTAL DISPLAY

This application claims the benefit of U.S. Provisional Application No. 60/070,950, filed Jan. 9, 1998.

BACKGROUND AND SUMMARY OF THE INVENTION

The present invention relates generally to the gamma correction of the viewing angle of a liquid crystal display, and more particularly, to a circuit which utilizes a plurality of digital-to-analog converters to adjust the viewing angle of a liquid crystal display. Compared to other display devices, liquid crystal displays operate at a low voltage in a limited amount of space, and they are light weight and low cost. As a result, liquid crystal displays are widely used as displays for computers, calculators, and security systems. In addition, liquid crystal displays have been particularly useful in avionic instrumentation display units.

The majority of modem military, commercial, and private aircraft instrumentation panels utilize ARINC cutouts for the avionic instrumentation display units. In other words, there is a standard instrumentation panel cutout for each avionic instrumentation display unit. As a result, only a limited amount of space is available to insert and wire the avionic instrumentation display units. At the same time, however, a need exists for additional processing devices in the avionic instrumentation display units. Consequently, space-conservative liquid crystal displays have largely replaced bulky cathode ray tube displays in avionic instrumentation display units.

Liquid crystal displays produce images by manipulating the orientation of liquid crystalline substances. The birefringence of a layer of liquid crystalline substance can be adjusted by applying a voltage across the layer. Consequently, the light which is transmitted through a layer of liquid crystalline substance can be controlled by changing the voltage across the layer.

In a typical liquid crystal display, segmented electrodes are utilized to generate the images of the display. The segmented electrodes are arranged in a pattern on the display, and they are driven individually by electronic circuitry. By applying voltages to a desired combination of segmented electrodes, the electronic circuitry can control the amount of light which is transmitted through the segmented electrodes. In this manner, the electronic circuitry can manipulate the image which is produced on the liquid crystal display.

However, it is well known to display engineers that liquid crystal displays which utilize the aforementioned technology suffer from a narrow field of view. The viewing quality of a liquid crystal display is partly determined by its contrast ratio. The contrast ratio of a liquid crystal display is limited by the amount of light that leaks through the segmented electrodes while they are in a dark state. Typically, the maximum contrast ratio of a liquid crystal display is achieved only within a narrow viewing angle centered about normal incidence. As the viewing angle is increased, the contrast ratio is diminished due to increased light leaking through segmented electrodes which are in dark states. Consequently, it becomes increasingly difficult to see images on the display as the viewing angle is increased.

As a result of the narrow field of view, the effectiveness of liquid crystal displays has been compromised in applications that require wide viewing angles. In particular, the narrow field of view has limited the effectiveness of liquid crystal displays in avionic instrumentation display units. Avionic instrumentation display units may require a wider field of view such that a pilot and a co-pilot can simultaneously view the display. Therefore, a need exists to increase the field of view of liquid crystal displays.

In order to address this need, many liquid crystal displays are pivotable such that the user may rotate the display for maximum contrast. However, a pivotable display may create reliability problems, and it increases the cost and complexity of the display system. Moreover, a pivotable display does not increase the field of view. It merely changes the direction of the display screen. Therefore, a pivotable display is not viable for applications that require a wide field of view or multiple users.

As mentioned above, it is also known that a bias voltage can be applied across a layer of liquid crystalline substance in order to control the amount of light that is transmitted through the layer. A bias voltage can be used in this manner to adjust the viewing angle of a liquid crystal display. In order to adjust the bias voltage, it is known to use a potentiometer or a combination of fixed and variable resistors. The accuracy and stability of a potentiometer, however, decreases with wear. Moreover, the setting of a potentiometer can accidentally be moved if the adjustment knob is not recessed, and a screwdriver is required to change the setting of the potentiometer if the adjustment knob is recessed. On the other hand, a combination of fixed and variable resistors is commonly used in applications such as avionic instrumentation display units. However, the resistors in this type of circuit may have to be physically replaced in order to change the viewing angle of the display. Consequently, this method of adjusting the viewing angle is often not feasible or practical for applications such as avionic instrumentation display units that may frequently require an adjustment of the viewing angle.

In light of the shortcomings of known liquid crystal displays, a need exists for a method and apparatus for adjusting the viewing angle of a liquid crystal display without the use of resistor trees. Still another need exists for a programmable method and apparatus which is adapted to provide the desired gamma correction for any video signal source.

The present invention meets some or all of these needs by replacing known resistor trees with a plurality of digital-to-analog converters. The plurality of digital-to-analog converters are arranged in pairs which have a fixed relationship. By determining appropriate values for the digital-to-analog converters, a desired viewing angle may be obtained for a liquid crystal display.

In addition to the novel features and advantages mentioned above, other objects and advantages of the present invention will be readily apparent from the following descriptions of the drawings and preferred embodiments.

BRIEF DESCRIPTION OF THE DRAWINGS

FIG. 2 is a graph of the individual output curves of the digital-to-analog converter trees during testing of the present invention;

DETAILED DESCRIPTION OF PREFERRED EMBODIMENT(S)

The present invention is directed to a circuit which utilizes a plurality of digital-to-analog converters to adjust the viewing angle of a liquid crystal display. The present invention is also directed to a method for adjusting the viewing angle of a liquid crystal display. The apparatus of the present invention replaces known resistor trees with a plurality of digital-to-analog converters. The plurality of digital-to-analog converters are arranged in pairs which have a fixed relationship.

By determining appropriate values for the digital-to-analog converters, a desired viewing angle may be obtained for a liquid crystal display. The gamma corrections desired for the input video signal, the offset caused by the desired viewing angle, and the new center number may be calculated knowing the fixed relationship between the digital-to-analog converters in each pair, the desired input gamma correction, and the desired viewing angle. After the gamma corrections, the offset, and the new center number are calculated, the values for the digital-to-analog converters in each pair may be calculated.

As a result of the calculated values for the digital-to-analog converters, a preferred embodiment of a circuit of the present invention is adapted to adjust the shape and offset of the gamma curve. The viewing angle may, therefore, be steered without losing shades of gray or bunching the near maximum video values together. As a further result of the calculated values or the digital-to-analog converters, the individual digital-to-analog converter trees are adapted to roduce a balanced light output. Consequently, more light results with both of the digital-to-analog converter trees driving the liquid crystal display, and the liquid crystal display is substantially flicker-free.

In order to adjust the brightness or viewing angle of the display, a user may input data which commands a desired change in the brightness or viewing angle of the display. In addition, the present invention is programmable such that the viewing angle may be adjusted for any video signal source. For instance, a preferred embodiment of the present invention includes a microprocessor which is adapted to control the adjustment of the viewing angle.

Figure 1A:
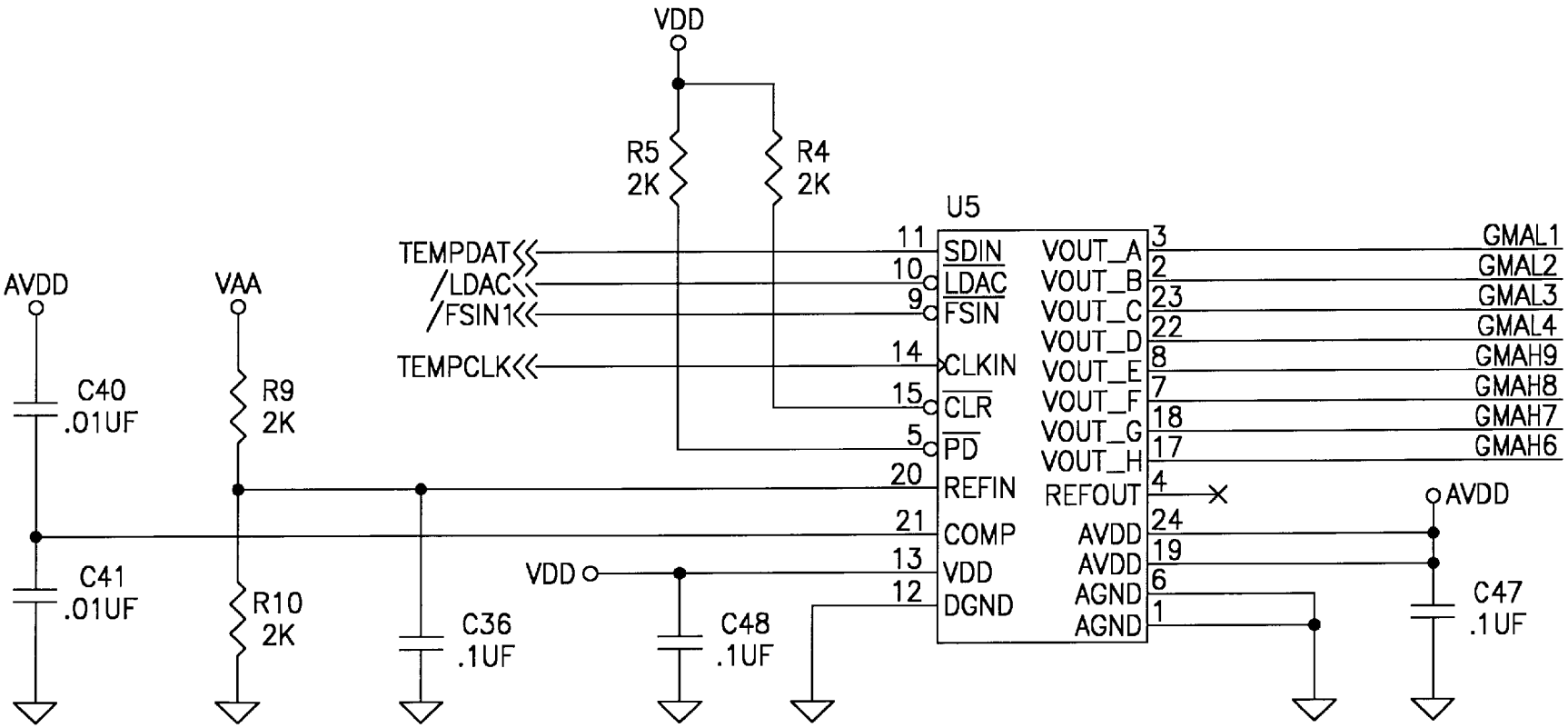
FIG. 1 is a circuit diagram of a preferred embodiment of a display interface of the present invention.
Figure 1B:
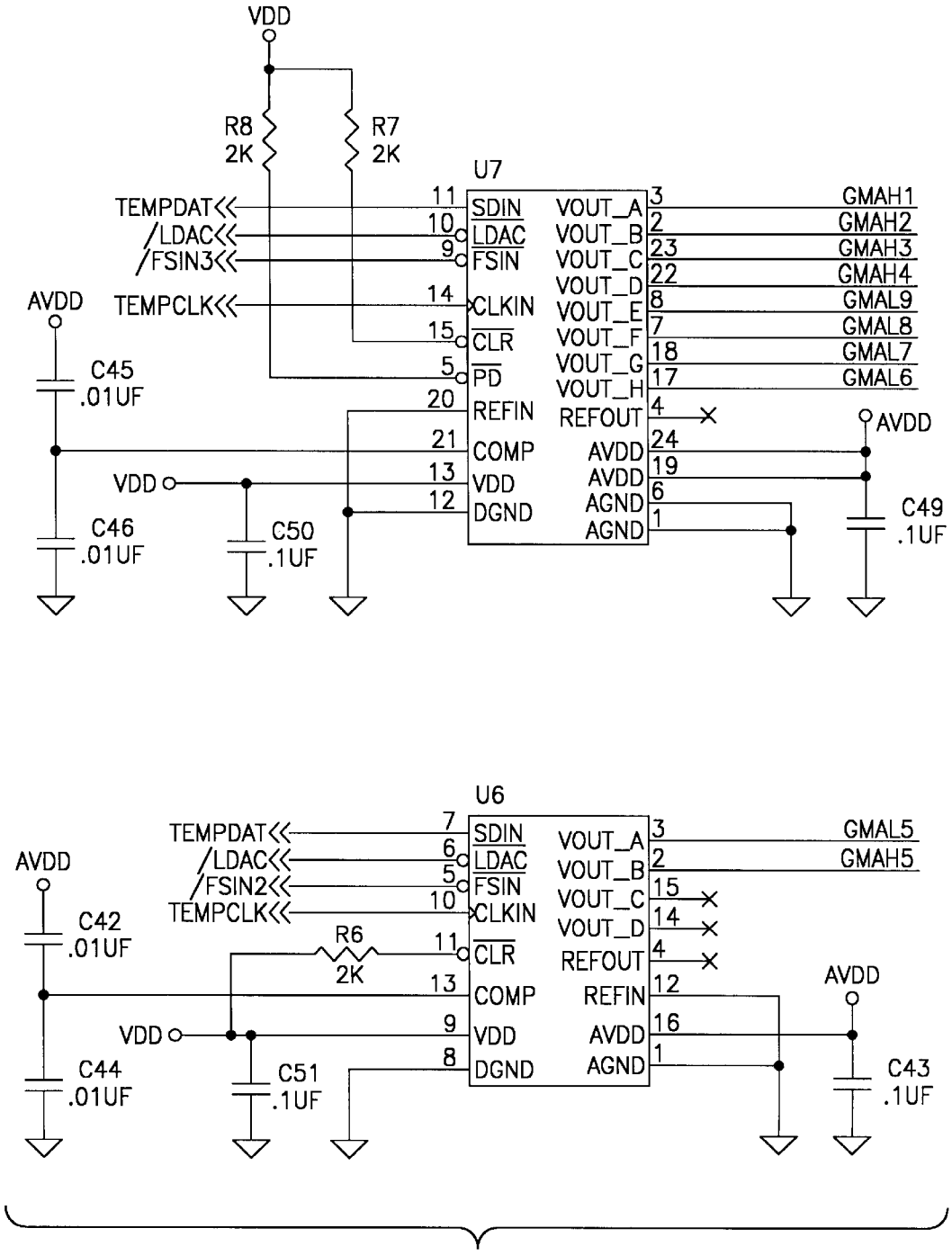
Figure 1C:
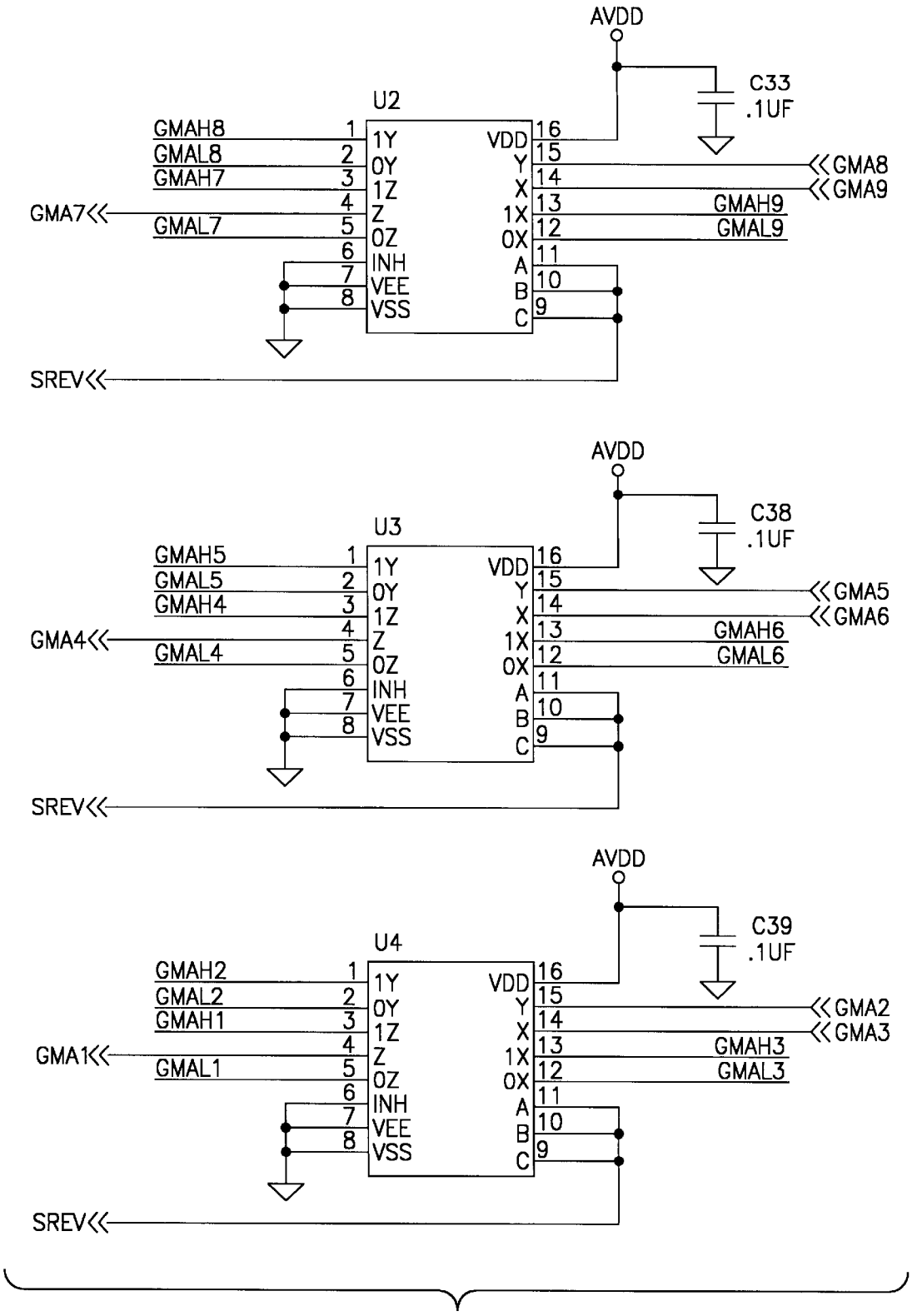

The output terminals of the digital-to-analog converters are preferably connected to a plurality of integrated circuits which comprise a video signal processing circuit. Furthermore, the output terminals of the video signal processing circuit are preferably connected to a liquid crystal matrix panel. FIG. 1 illustrates a circuit diagram of a preferred embodiment of the display interface of the present invention.

It should be recognized by those skilled in the art that other embodiments of the present invention may be achieved utilizing the techniques disclosed in the specification. For instance, the number of pairs of digital-to-analog converters may vary according to the intended use of the liquid crystal display. Consequently, the fixed relationship between the digital-to-analog converters in each pair may vary, the disclosed equations may vary, and the values for the digital-to-analog converters may vary.

EXAMPLE

The gamma tree investigation began with picking the values for the 18 digital-to-analog converters (DACs) on the display interface board which would result in substantially linear light output for linear voltage input and steering the viewing angle. This investigation was extended to include being able to apply an arbitrary gamma function to the light output. The end result of the successful investigation was the following equations which begin with the desired gamma correction to the input signal and the viewing angle and result in a set of 18 DAC values which will provide the desired picture.

The 18 DACs were arranged as 9 pairs of DACs which had the fixed relationship shown. The output from the DAC pairs was fed into an additional circuit which provided 7 additional linear steps between the settings of each DAC pair such as between G1 and G2 or G5 and G6.

| | First DAC | Second DAC |
|---|---|---|
| G1 - 0/63 - 0.0000 | D0 | D8 |
| G2 - 7/63 - 0.1111 | D1 | D9 |
| G3 - 15/63 - 0.2381 | D2 | D10 |
| G4 - 23/63 - 0.3651 | D3 | D11 |
| G5 - 31/63 - 0.4951 | D16 | D17 |
| G6 - 39/63 - 0.6190 | D15 | D7 |
| G7 - 47/63 - 0.7460 | D14 | D6 |
| G8 - 55/63 - 0.8730 | D13 | D5 |
| G9 - 63/63 - 1.0000 | D12 | D4 |

For this example, the formula to compute the DAC values are as follows:

Step 1

Calculate the gamma correction desired for the input video signal.

$Gx_y=(Gx)^y$ y is the desired input gamma correction

Step 2

Calculate the offset caused by the desired viewing angle (currently up to 45°) θ=the desired viewing angle

| | |
|---|---|
| for θ<=19° | offset = $160(\theta/19°)^{3.5}$ |
| for 45°>=θ>19° | offset = $352-[192((45°-\theta)/26°)^{1.6}]$ |

Step 3

Calculate the new center number if offset<=320

This is a two step process for offset<=320:

$temp=(0.4925)*(offset/320)^{2.7}$ center=(0.4925−temp)/(1−temp)

if offset>320 then center=0

Step 4

Calculate the first DAC value for the gamma corrected values of G1–G9 if offset<=320 and $Gx_y$<=center $FDx=offset+(320-offset)*(Gx_y/center)^{1/2.7}$ if offset<=320 and $Gx_y$>center $FDx=608-(288*((1-Gx_y)/(1-center))^{1/2.7})$ if offset>320

$FDx=608-((288-(offset-320))*((1-Gx_y)^{1/2.7})$

Step 5

Calculate the second DAC value from the first DAC value for G1–G9

| | |
|---|---|
| if FDx<=320 | $SDx = 784 - (424) * (FDx/320)^{1/1.35}$ |
| if FDx>320 | $SDx = 201 + (159) * ((608 - FDx)/288)^{1.7}$ |

Step 6

Convert the decimal values to hexadecimal values as follows:

| | |
|---|---|
| if 0<=Dx<512 | Dx = Dx + 512 then convert to hexadecimal |
| if 512<=Dx<1024 | Dx = Dx − 512 then convert to hexadecimal |

The following samples from the testing are provided to demonstrate the application of the above equations to result in the desired DAC values for the display. The results of these samples have been verified on a display.

Sample 1 gamma correction 1, viewing angle 0

Since the gamma correction is 1, use the G1–G9 values as is.

Since the viewing angle is 0, offset=0

Since offset=0 center=0.4925

Calculating the first DAC values produces:

D0=0
D1=184
D2=244
D3=286
D16=320
D15=349
D14=385
D13=436
D12=608

Calculating the second DAC values produces:

D8=784
D9=502
D10=437
D11=394
D17=360
D7=334
D6=304
D5=267
D4=201

Converting the decimal values to hexadecimal results in the following table:

| | |
|---|---|
| D0 = 200H | D8 = 110H |
| D1 = 2B8H | D9 = 3F6H |
| D2 = 2F4H | D10 = 3135H |
| D3 = 31EH | D11 = 38AH |
| D16 = 340H | D17 = 368H |
| D15 = 35DH | D7 = 34EH |
| D14 = 381H | D6 = 330H |
| D13 = 3B4H | D5 = 30BH |
| D12 = 60H | D4 = 2C9H |

The resulting display actually has a viewing angle around 4°. However if the equation in step 2 is examined it will be noted that very little change is produced up to approximately 8° which is very close to how the display operates.

Sample 2 gamma correction 1, viewing angle 10°

Since the gamma correction is 1, use the G1–G9 values as is.

Since the viewing angle is 10°, offset=17

Since offset=17 center=0.4924

Calculating the first DAC values produces:

D0=17
D1=192
D2=248
D3=288
D16=321
D15=349
D14=386
D13=436
D12=608

Calculating the second DAC values produces:

D8=735
D9=470
D10=430
D11=390
D17=357
D7=332
D6=302
D5=266
D4=201

Converting the decimal values to hexadecimal results in the following table:

| | |
|---|---|
| D0 = 211H | D8 = E0H |
| D1 = 2C0H | D9 = 3EEH |
| D2 = 2F8H | D10 = 3B0H |
| D3 = 320H | D11 = 388H |
| D16 = 341H | D17 = 367H |
| D15 = 35DH | D7 = 34EH |
| D14 = 381H | D6 = 330H |
| D13 = 3B4H | D5 = 30BH |
| D12 = 60H | D4 = 2C9A |

Sample 3 gamma correction 0.7, viewing angle 25

Since the gamma correction is 0.7 the resulting G1–G9 table is:

G1=0.0000
G2=0.2148
G3=0.3662
G4=0.4940
G5=0.6113
G6=0.7148
G7=0.8145
G8=0.9093
G9=1.0000

Since the viewing angle is 25, offset 226

Since offset=226 center=0.3715

Calculating the first DAC values produces:

D0=226
D1=303
D2=319
D3=342
D16=366
D15=393
D14=425
D13=467
D12=608

Calculating the second DAC values produces:

D8=456
D9=377
D10=361
D11=340
D17=319
D7=298
D6=275
D5=248
D4=201

Converting the decimal values to hexadecimal results in the following table:

| | |
|---|---|
| D0 = 2E2H | D8 = 3C8H |
| D1 = 32FH | D9 = 379H |
| D2 = 33FH | D10 = 369H |
| D3 = 356H | D11 = 354h |
| D16 = 36EH | D17 = 33FH |
| D15 = 389H | D7 = 32AH |
| D14 = 3A9H | D6 = 313H |
| D13 = 3D311 | D5 = 2F8H |
| D12 = 60H | D4 = 2C9H |

A preferred method for deriving the above equations will now be described. In order to derive the above equations, the first problem to be solved was isolating the DAC trees so they could be investigated individually. The display was driven with one DAC tree from 0 VDC and up on one line and then on the next line the display was driven from the other DAC tree at some positive voltage and down. The lines which were driven by a DAC tree swapped at each field boundary.

The result of a series of detailed measurements was individual curves for each DAC tree. The graph in FIG. 2 shows the results of the measurements. The graph shows that the two sets of DACs did not produce a balanced output. If the DAC outputs are not balanced for a given light output, the result is a 30 Hz flicker which is very noticeable and objectionable. This means that the DAC that produces the least light limits the total light out from the display (a little) because the other DAC must be limited to the same light output. This difference is preferably accounted for in step 5 of the above equations.

Once data was available for how the two DAC trees behaved, the DACs were adjusted to produce a balance light output. The first DACs were chosen to be the control case since they limited the total light output. Linear steps were chosen from 0 to 608 in steps of 32 for the first DAC values and DAC values were chosen for the second set of DACs which resulted in a balanced light output. These drives were verified to be balanced and then the total light output was measured with both DACs producing the same individual light output.

Figure 3:
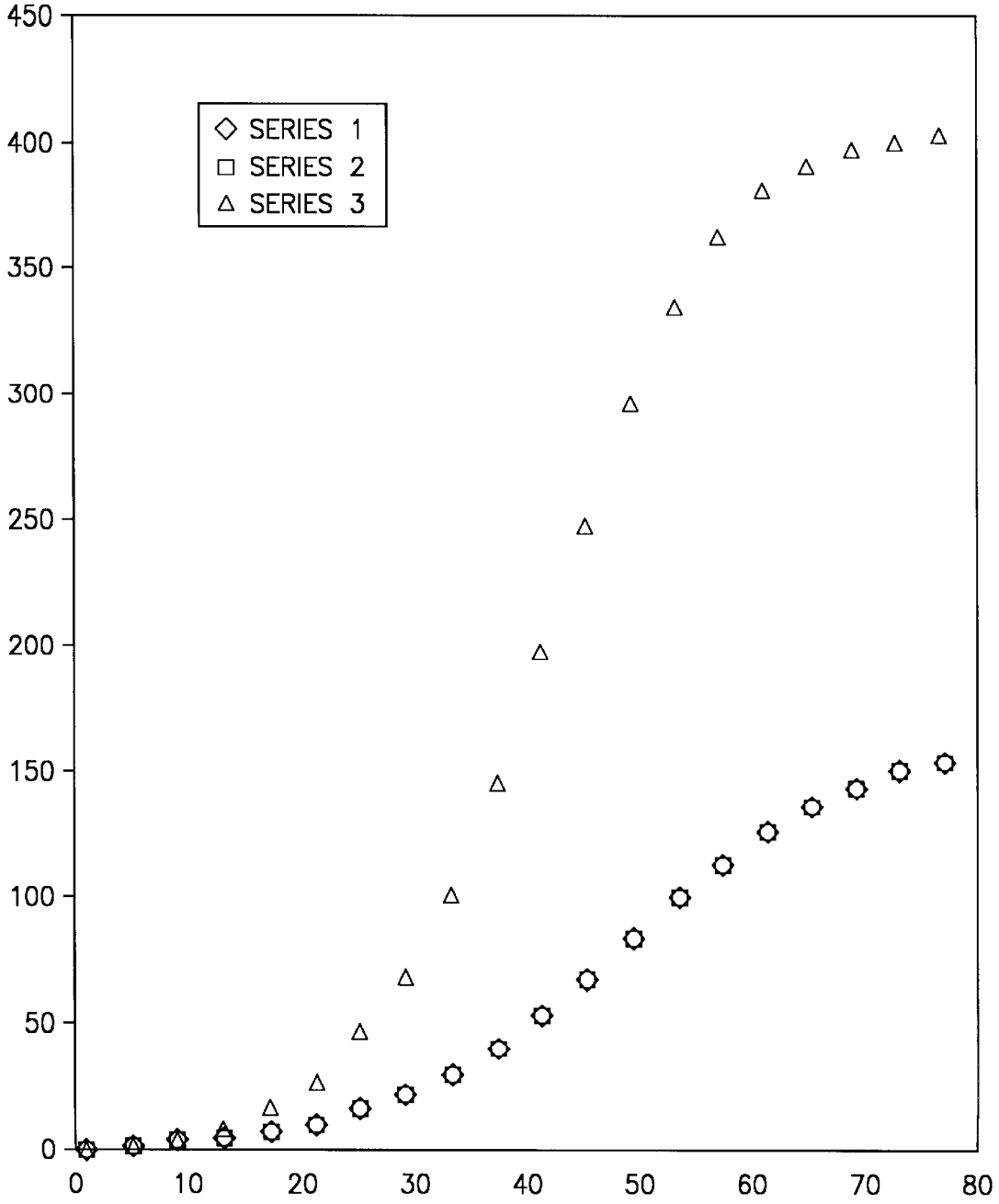
FIG. 3 is a graph of the light output when driven by one digital-to-analog converter tree or both digital-to-analog converter trees during testing of the present invention.

The graph in FIG. 3 indicates the results of this portion of the investigation. As can be seen from series 1 and 2, the resultant light out of the individual DAC trees was well balanced. Series 3 show the results of the light output with both of the DACs driving. The result was not a summation of the individual DAC light outputs. More light resulted when the two trees were combined than was available from the individual trees.

The next step was to derive an equation that would approximate the shape of the total light output so that the desired light output could be converted to DAC values for both DAC trees. To enable a simple equation for approximating the total light output, the light output was split at the approximate midpoint. The point chosen for the split was 320 (198.98 fL). This point was at 49.25% of the total light output.

The equation for the first part of the line was: for x=0 to 320: $(x/320)^{2.7}*198.98$ fL.

The equation for the second part of the line was:

for x=321 to 608

$$403.98-(403.98-198.98)*((608-x)/(608-320))^{2.7}$$

Figure 4:
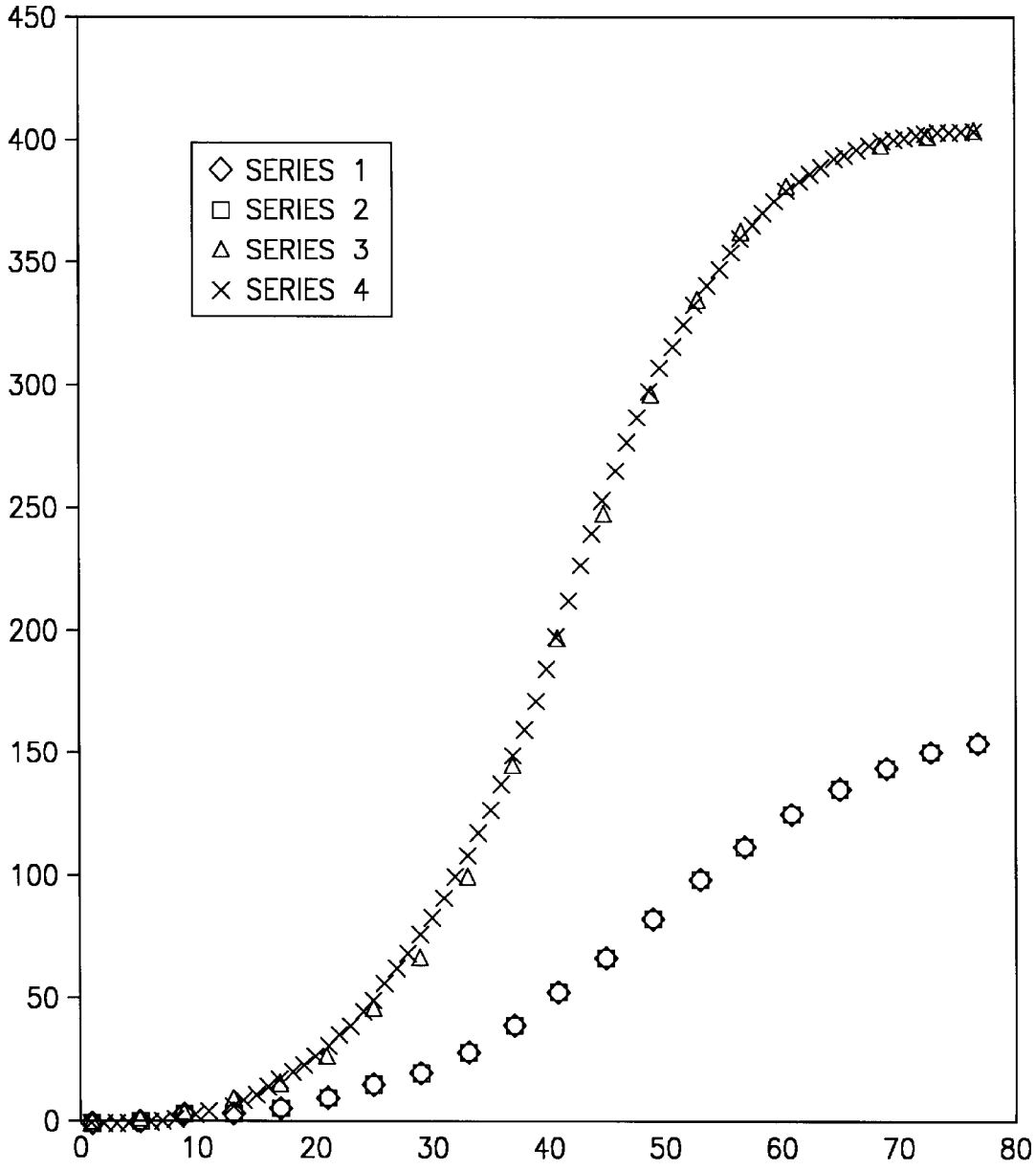
FIG. 4 is a graph comparing test equations with the measured data during testing of the present invention.

The comparison of this calculated line to the measured data can be seen in the graph in FIG. 4. The equations substantially reproduced the measured data as shown in series 4 and allowed for computer calculation of the first DAC value necessary to produce a desired light output. The equations in step 4 allow this calculation to be performed (with the addition of some offsets for viewing angle).

Steering the viewing angle in very simple terms may just be uniformly raising the background. In known methods, this is accomplished by adding constant digital value to all of the digital video data and pegging the maximum at the maximum digital video data value. This accomplished viewing angle steering at the price of losing shades of gray and bunching the near maximum video values together.

In order to steer the viewing angle with the DACs, the background DACs (D0 and D8) were set to whatever light output produced the desired viewing angle, and the percentages that each step produced a new uniform (or gamma corrected) output were recalculated. As a result, the viewing angle was successfully steered and 64 shades of gray were maintained.

Figure 5:
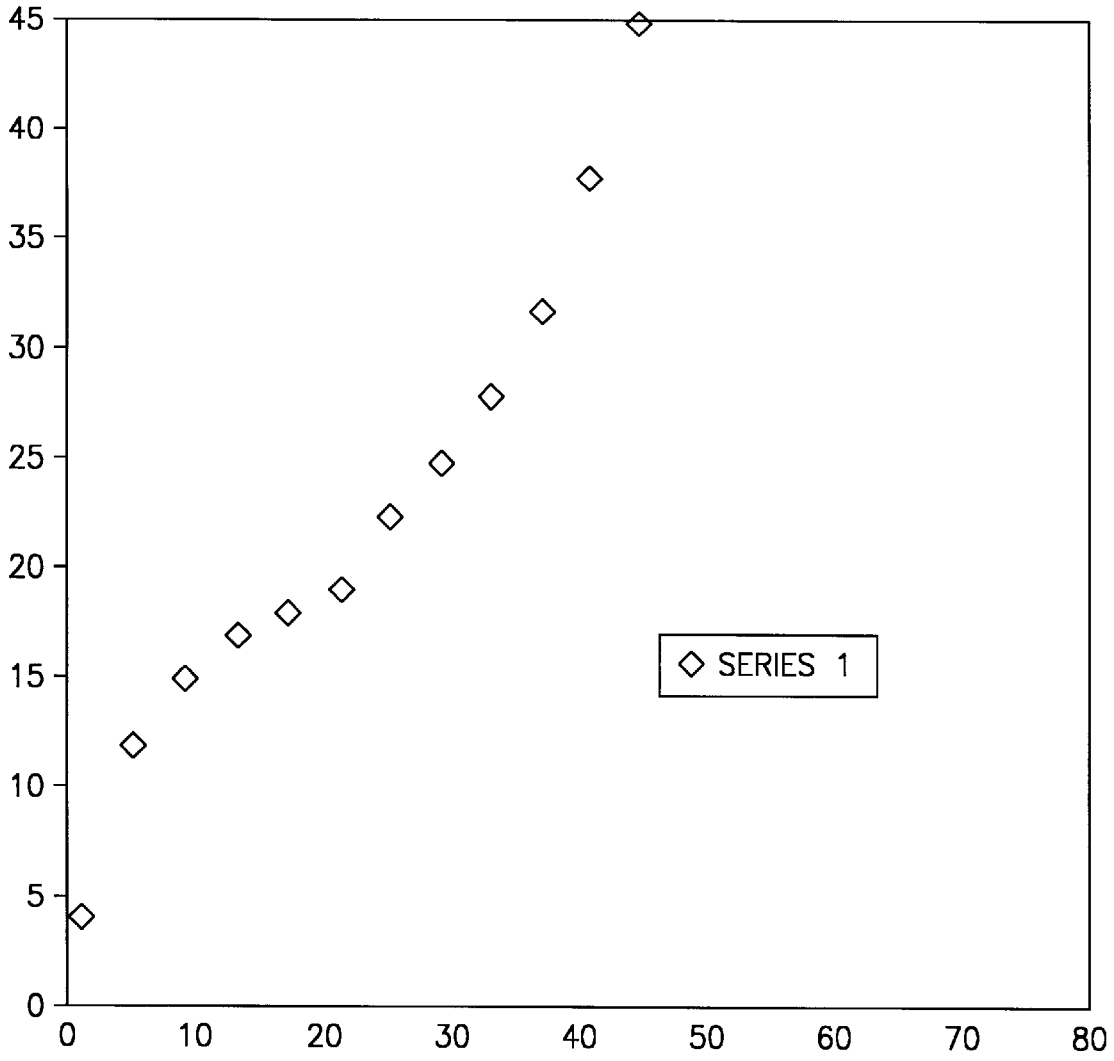
FIG. 5 is a graph showing the effect that varying the background light output had on the viewing angle during testing of the present invention.

The background light output was varied and the effect on viewing angle was measured as shown in the graph in FIG. 5. The result was nonlinear. Nineteen degrees was decided to be where the curve changed polarity so the following set of equations were derived to approximate the curve:

| | | |
|---|---|---|
| if θ<=19 degrees | for x = 0 to 160 | $19 * (x/160)^{1/3.5}$ |
| if 45 >=θ>19 degrees | for x = 352 to 161 | $45 - 19 * ((352 - x) / 192)^{1/1.6}$ |

Figure 6:
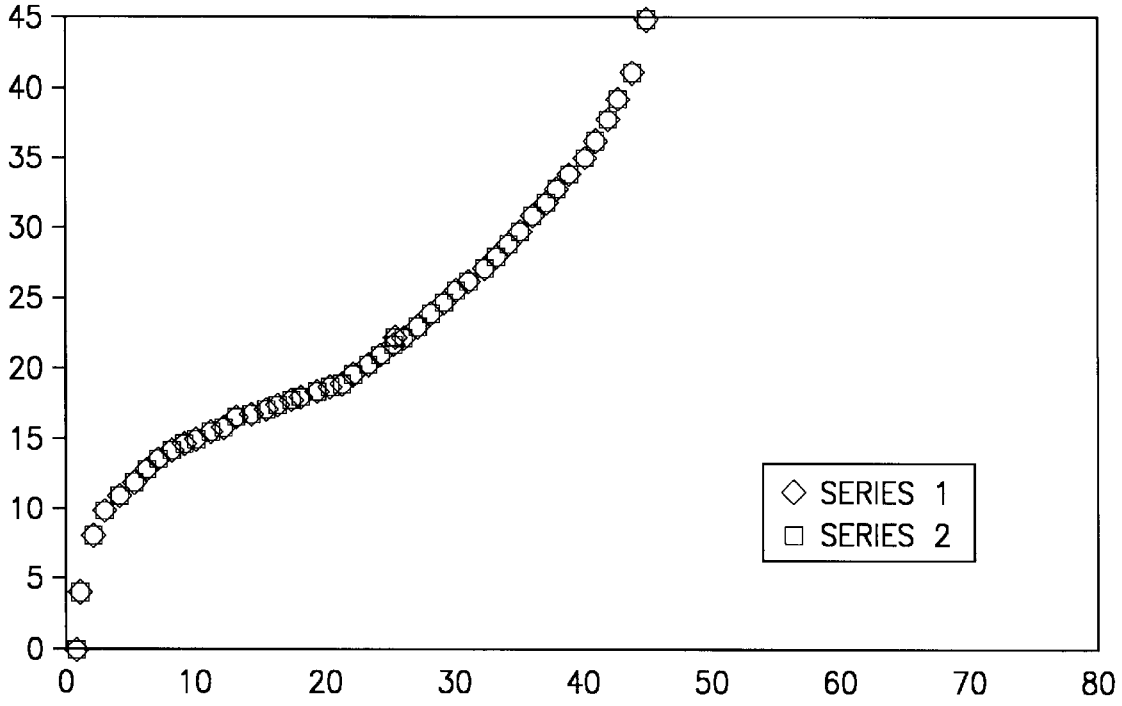
FIG. 6 is a graph comparing the measured viewing angle to the calculated viewing angle during testing of the present invention.

The graph in FIG. 6 shows the comparison of the measured viewing angle to the calculated viewing angle. The equations substantially matched the measured data. This data was used in step 2 to calculate the floor of the brightness as a function of viewing angle. When the floor is changed, the percentage of brightness at the mid point of the equation (320) must be recalculated. This is performed in Step 3.

Finally, an external gamma correction was applied. The fixed percentages for G1–G9 (actually G2–G8) were recalculated with the gamma correction that was requested.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method for determining values of digital-to-analog converters for steering of the viewing angle of a liquid crystal display, said method comprising:

providing a first set of digital-to-analog converters that are in electrical communication with at least one light source;

providing a second set of digital-to-analog converters that are in electrical communication with said at least one light source;

arranging said digital-to-analog converters in pairs, each of said pairs comprising a respective one of said digital-to-analog converters of said first set and a respective one of said digital-to-analog converters of said second set;

driving said at least one light source with said first set of digital-to-analog converters to produce a first light output;

driving said at least one light source with said second set of digital-to-analog converters to produce a second light output;

determining a relationship of said pairs of said digital-to-analog converters such that said first light output and said second light output are balanced;

driving said at least one light source with said first set and said second set of digital-to-analog converters to produce a third light output;

determining an equation approximating said third light output;

providing a desired viewing angle and a desired input gamma correction;

determining a gamma correction of said relationship of said pairs of said digital-to-analog converters, said gamma correction being a function of said desired input gamma correction;

determining an offset caused by said desired viewing angle, said offset being a level of light output as a function of said desired viewing angle;

determining a center number, said center number being a percentage of said third light output at a predetermined point of said equation taking into account said offset;

determining a first value of a first one of said digital-to-analog converters in each of said pairs, said first value being a function of said gamma correction, said offset, and said center number; and determining a second value of a second one of said digital-to-analog converters in each of said pairs, said second value being a function of said first value in each of said pairs.

* * * * *

UNITED STATES PATENT AND TRADEMARK OFFICE

CERTIFICATE OF CORRECTION

PATENT NO. : 6,297,790 B1
DATED : October 2, 2001
INVENTOR(S) : Joseph W. Goode, III et al.

It is certified that error appears in the above-identified patent and that said Letters Patent is hereby corrected as shown below:

Column 1,
Line 20, please delete the word "modem" and replace it with -- modern --.

Column 3,
Line 37, please delete the word "or" and replace it with -- for --.
Line 38, please delete the word "roduce" and replace it with -- produce --.

Column 5,
Line 55, please delete "=3135H" and replace it with -- =3B5H --.

Column 6,
Line 41, please delete "=2C9A" and replace it with -- =2C9H --.
Line 56, after the word "offset" and before the number "226", please insert the symbol -- = --.

Column 7,
Line 21, please delete "=3D311" and replace it with -- =3D3H --.

Signed and Sealed this

Twenty-sixth Day of March, 2002

*Attest:*

*Attesting Officer*

JAMES E. ROGAN
*Director of the United States Patent and Trademark Office*